US005720428A

United States Patent [19]

Jensen

[11] Patent Number: 5,720,428

[45] Date of Patent: Feb. 24, 1998

[54] STAND-UP FRENCH FRY SCOOP

[75] Inventor: Kurt D. Jensen, Cincinnati, Ohio

[73] Assignee: International Paper, Purchase, N.Y.

[21] Appl. No.: 811,315

[22] Filed: Mar. 4, 1997

[51] Int. Cl.[6] ..... B65D 5/42

[52] U.S. Cl. ..... 229/104; 229/163; 229/405

[58] Field of Search ..... 229/104, 163, 229/400, 405; 220/628, 633, 635

[56] References Cited

U.S. PATENT DOCUMENTS

| | | | |
|---|---|---|---|
| 1,680,028 | 8/1928 | Ryan et al. . | |
| 2,105,243 | 1/1938 | Gruber et al. | 229/163 |
| 2,114,492 | 4/1938 | Horr . | |
| 2,165,277 | 7/1939 | Koch et al. | 229/405 |
| 3,630,430 | 12/1971 | Struble . | |
| 3,845,897 | 11/1974 | Buttery et al. . | |
| 3,877,632 | 4/1975 | Steel . | |
| 4,185,764 | 1/1980 | Cote . | |
| 4,267,955 | 5/1981 | Struble . | |
| 4,433,778 | 2/1984 | Maio et al. | 229/104 |
| 4,638,941 | 1/1987 | Watson | 229/104 |
| 4,867,374 | 9/1989 | Murray et al. . | |
| 5,476,215 | 12/1995 | Baroud | 229/104 |

FOREIGN PATENT DOCUMENTS

| | | | |
|---|---|---|---|
| 488826 | 12/1952 | Canada | 229/104 |
| 94119 | 6/1959 | Norway | 229/400 |

*Primary Examiner*—Gary E. Elkins
*Attorney, Agent, or Firm*—Michael J. Doyle

[57] ABSTRACT

A french fry scoop formed from a unitary blank of paperboard is provided with generally horizontally extending lower legs. The legs extend tangentially from the lower edges of the scoop and permit the filled scoop to be placed on a horizontal surface in slightly tilted, stable equilibrium. The scoop displays both economy in paperboard required and a pleasing rest position from which the consumer can withdraw product.

4 Claims, 2 Drawing Sheets

STAND-UP FRENCH FRY SCOOP

BACKGROUND OF THE INVENTION

This invention relates to a french fry scoop of the type formed from a unitary blank of paperboard, such scoops displaying utility in the serving of french fried potatoes at fast food outlets.

Typical filled french fry scoops used in food service applications will not stand upright on a table or serving tray surface due to their high center of gravity and narrow base dimensions. Because the filled scoop is usually laid down on one of its sides on a table or tray, a poor presentation of product results and some product may spill out. Additionally, when a serving tray contains multiple food items, laying down the scoop takes up considerable space. To overcome this drawback, french fry scoops have evolved which will stand vertically on a flat surface, examples being shown in U.S. Pat. Nos. 3,877,632 issued to Steel, and 3,845,897 issued to Buttery. However, these constructions require more paperboard than that of the present invention.

SUMMARY OF THE INVENTION

According to the practice of this invention, the french fry scoop stands almost vertically, but tilts somewhat to provide further stability and a unique and pleasing appearance. The invention is based on a flat glued style of french fry scoop of the type which is squeezed to open and which snaps into its erected, open position by pushing up its bottom panel. The design employs two glue flaps from respective edge gussets which attach to the rear side wall. The glue flaps are adjacent edge gussets.

According to the invention extensions which form two supporting legs project tangentially from the lower portions of two opposite edge gussets, the two legs extending past and away from the back or rear side wall of the scoop. The legs effectively create a larger base for the scoop and allow it to stand in stable equilibrium slightly tilted from the vertical.

DETAILED DESCRIPTION OF THE INVENTION

Figure 1:
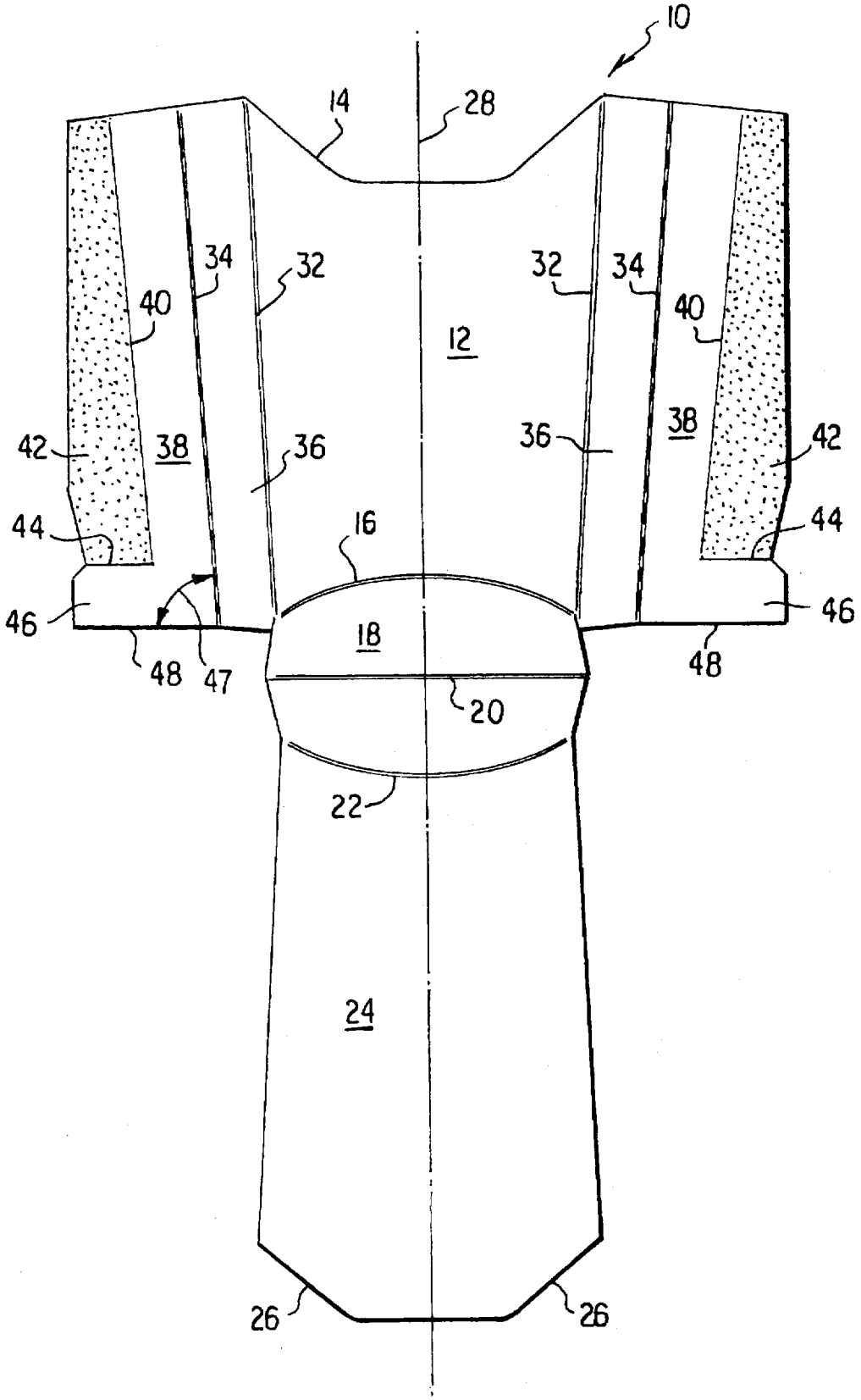
FIG. 1 is a plan view of a unitary blank of paperboard from which the scoop is formed, what will be the inside surface of the scoop facing the reader.

Referring now to FIG. 1, a unitary paperboard blank for forming the scoop is denoted generally as 10 and includes a first side wall or panel 12, which will be the front wall of the scoop, having a recessed free upper edge 14. A curved fold line 16 is located at the bottom of panel 12, the fold 16 communicating with generally oval bottom wall panel 18, the latter having a central fold line 20 extending across its width. Curved fold line 22 joins bottom wall 18 and second side wall or panel 24, the latter which will be the rear wall of the scoop, and is located at the top of side wall 24. The bottom of side wall 24 is provided with slanted corner portions 26.

Blank 10 is mirror symmetrical about vertical mid-axis 28, hence a description of those panels to the left of side wall 12 will also describe those to the right. Both vertical side edges of side wall 12 are bordered by fold lines 32, with elongated gusset panel 36 located between fold lines 32 and 34. Similarly, elongated gusset panel 38 is positioned between fold lines 34 and 40, with the bottom of fold line 40 extending laterally and terminating in a cut 44 completely through the paperboard. Fold line 40 and cut line 44, with the upper left free edge of the blank, define glue panel 42. This construction defines a lower leg 46 extending generally laterally from panels 36 and 38, each leg 46 having a lower support engaging edge 48. Panel 38 and leg 46 define a generally L-shaped panel, with elongated portion 38 being generally vertical, and leg portion 46 being generally horizontal. Panels 36 and 38 define edge gusset panels. The angle 47 between leg 46 and fold line 34 is slightly less than 90 degrees, typically 87 degrees, to yield a tilt, soon to be described. Fold lines 32, 34, and 40 are each at a different angle to the vertical, to yield a somewhat tapered conical form to the erected scoop.

Figure 2:
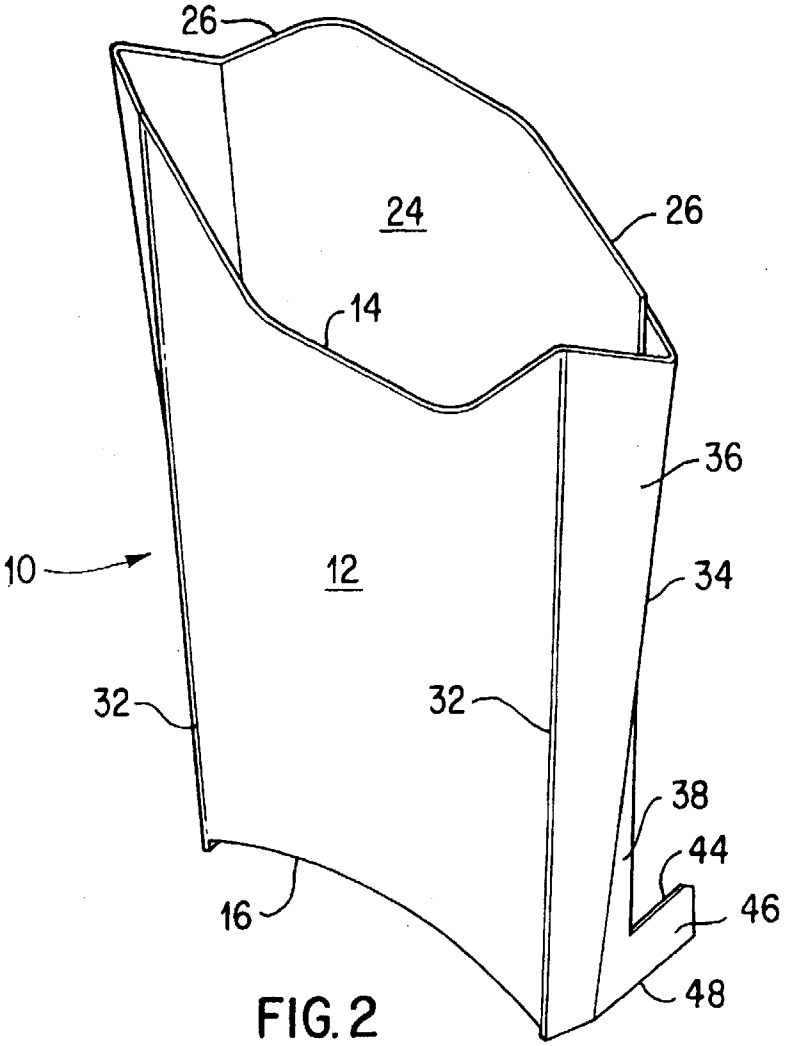
FIG. 2 is a perspective view of the rear of the erected scoop.

To assemble the blank, an adhesive (facing the reader and indicated by stippling) is placed on panels 42, and then side wall panels 12 and 24 folded into substantial parallelism, with glue panels 42 adhered to spaced portions of the external (away from the reader) surface of rear side wall 24. This folding, together with the shape of bottom wall 18 and curved fold lines 16 and 22, yields a flattened scoop erected by squeezing the edges together and also pushing up on the middle of bottom wall 18, as in the manner shown at FIGS. 2 and 4 of U.S. Pat. No. 3,630,430 issued to Struble. Similar to that shown at FIG. 2 of Struble, bottom wall 18 is folded about line 20 and extends downwardly prior to erection. With such upward pushing, the scoop is snapped into a fully open configuration, as in the noted Struble construction.

Figure 3:
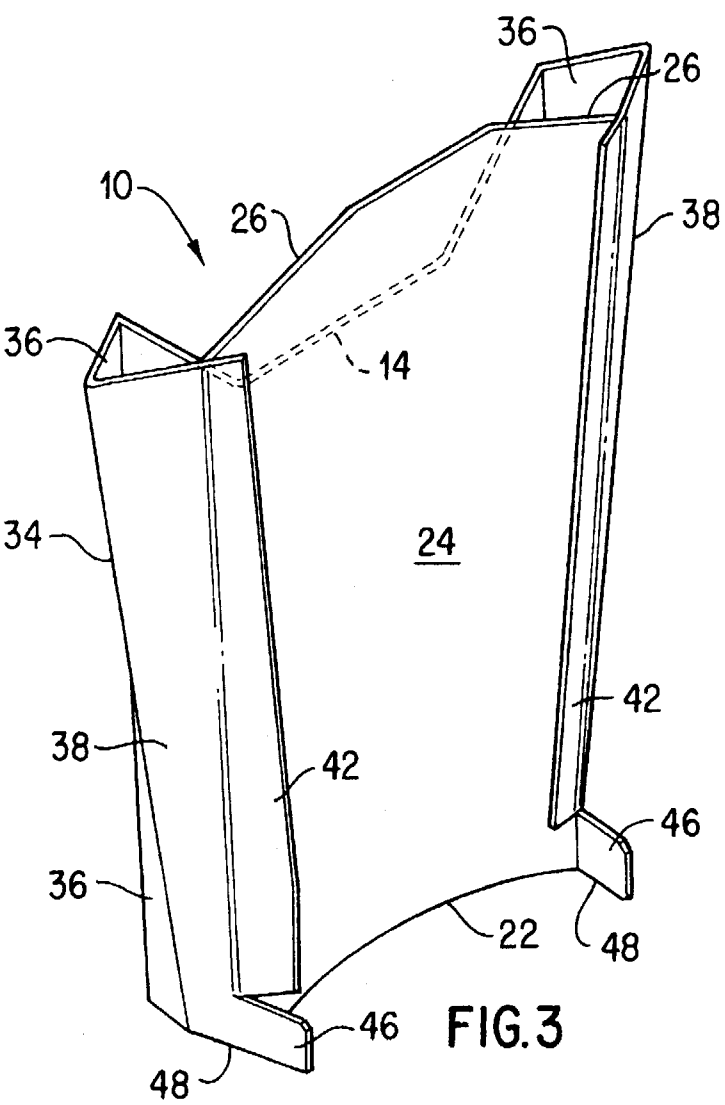
FIG. 3 is a perspective view of the front of the erected scoop.

FIGS. 3 and 4 show the scoop in its erected and open form. When on a flat surface such as a table or tray, the scoop tilts slightly from the vertical, resting on lower edges 48 of legs 46, the latter extending from opposite edges of the scoop. It is seen that legs 46 extend generally tangentially from a region contigous to bottom panel 18. This slightly tilted position is stable and also presents a different appearance in this aspect from the noted Steel and Buttery scoops/containers which are exactly vertical. The approximate center of gravity of the french fry filled scoop is above respective mid portions of edges 48, thus yielding a stable rest configuration. Further, the slight tilt of the filled scoop yields a more pleasing and easier to view (than vertical) any graphics on the front side wall.

I claim:

1. A combination french fry scoop and container formed from a unitary blank of paperboard including:

a generally oval bottom panel, a pair of side walls, each foldably connected by a respective curved fold line to opposite portions of said bottom panel, a pair of edge gusset panels each located at respective opposite edges of one of said side walls, each of said pair of edge gusset panels foldably secured to a respective glue flap, said glue flaps glued to the other one of said side walls, each of said pair of edge gusset panels including an L-shaped panel having a generally vertical section and a generally horizontal section, said generally horizontal sections defining legs which extend generally tangentially from a region contiguous to said bottom panel.

2. The scoop of claim 1 wherein said generally vertical section and said generally horizontal section of each said L-shaped panel are at an acute angle to each other, whereby said scoop tilts from the vertical when resting on a horizontal supporting surface.

3. A unitary paperboard blank for forming a combination french fry scoop and container, said blank including:

a generally oval bottom panel, a pair of side wall panels each foldably connected by a respective fold line to opposite portions of said bottom panel, a pair of edge gusset panels each foldably attached to respective opposite edges of one of said side walls, each of said pair of edge gusset panels foldably secured to a glue flap, each of said pair of edge gusset panels each including an L-shaped panel having a generally vertical section and a lower, generally horizontal section, said generally horizontal sections defining supporting legs.

4. The blank of claim 2 wherein said generally vertical section and said generally horizontal section of each said L-shaped leg are at an acute angle to each other.

* * * * *